US011066128B2

(12) United States Patent
Bourlakov

(10) Patent No.: US 11,066,128 B2
(45) Date of Patent: Jul. 20, 2021

(54) COLLAPSIBLE MAST OF A YACHT

(71) Applicant: HERMITAGE FO SARL, Monaco (MC)

(72) Inventor: Oleg Bourlakov, Monaco (MC)

(73) Assignee: HERMITAGE FAMILY OFFICE SARL, Monaco (MC)

( * ) Notice: Subject to any disclaimer, the term of this patent is extended or adjusted under 35 U.S.C. 154(b) by 98 days.

(21) Appl. No.: 16/493,009

(22) PCT Filed: Mar. 16, 2018

(86) PCT No.: PCT/EP2018/056759
§ 371 (c)(1),
(2) Date: Sep. 11, 2019

(87) PCT Pub. No.: WO2018/167311
PCT Pub. Date: Sep. 20, 2018

(65) Prior Publication Data

US 2020/0010152 A1 Jan. 9, 2020

(30) Foreign Application Priority Data

Mar. 17, 2017 (NL) ..... 2018544

(51) Int. Cl.
*B63B 15/00* (2006.01)

(52) U.S. Cl.
CPC .. *B63B 15/0083* (2013.01); *B63B 2015/0058* (2013.01)

(58) Field of Classification Search
CPC ..... B63B 15/00; B63B 15/0083; B63B 2015/0058
See application file for complete search history.

(56) References Cited

U.S. PATENT DOCUMENTS 8,322,877 B1 * 12/2012 Merritt ..... F21V 21/15 362/220
8,757,514 B1 * 6/2014 Perello ..... B05B 15/60 239/280.5
2008/0156242 A1 7/2008 Knisely et al.

FOREIGN PATENT DOCUMENTS

DE 19925958 A1 12/2000
DE 102006009206 A1 8/2007
DE 102009005240 A1 * 7/2010 ..... B63B 15/00
FR 2810626 A1 12/2001

OTHER PUBLICATIONS

International Search Report and Written Opinion for the International Patent Application No. PCT/EP2018/056759, dated May 7, 2018, 10 pages.

* cited by examiner

*Primary Examiner* — Stephen P Avila
(74) *Attorney, Agent, or Firm* — Kacvinsky Daisak Bluni PLLC

(57) ABSTRACT

A collapsible mast of or for a yacht includes a base, a top section, and a rotation mechanism arranged between the base and the top section configured to rotate the top section relative to the base between an upright extended state, in which the top section extends in line with the base, and a collapsed state, in which the top section is rotated downward to reduce a height of the mast. The rotation mechanism comprises an axis oriented transverse through the base. Further, the rotation mechanism comprises a rotation arm, which is rotatably connected to the base via the axis.

17 Claims, 3 Drawing Sheets

COLLAPSIBLE MAST OF A YACHT

This is a national stage application filed under 35 U.S.C. § 371 of pending international application PCT/EP2018/056759 filed Mar. 16, 2018 which claims priority to Netherlands Patent application NL 2018544, filed Mar. 17, 2017, the entirety of which applications are incorporated by reference herein.

The present disclosure relates to a collapsible mast. More in particular the disclosure relates to a collapsible mast of or for a yacht.

Masts of yachts, especially relatively big yachts, are always fixed. However, as yacht are becoming progressively bigger, continuously extending masts pose a problem, if not a danger, under specific circumstances. In particular when sailing into marinas or under bridges, masts may engage and damage marina entrances and bridged. Consequently, there's a need for a solution.

The present disclosure is aimed at providing a solution, and to this end the mast of or for a yacht is made collapsible by comprising: a base; a top section; and a rotation mechanism arranged between the base and the top section configured to rotate the top section relative to the base between an upright extended state, in which the top section extends in line with the base, and a collapsed state, in which the top section is rotated downward to reduce a height of the mast.

According to this solution, the mast can be collapsed, when sailing towards a marina entrance or a bridge.

From DE-10-2006 009 206 A1, a collapsible mast of a sailing boat is known to have a transverse axis, on which the top section is rotatable relative to the base. The top section is fixed to the axis, or rotatable thereon.

More in particular, the mast exhibits a feature that the rotation mechanism comprises an axis oriented transverse through the base.

Further, the rotation mechanism comprises a rotation arm, which is rotatably connected to the base via the axis. The arm allows the rotation mechanism to encompass or embody any one of a distancer to keep the base and the top section apart from each other in a collapsed state and abut in the upright extended state, and a guide for the movement of the top section relative to the basis for collapsing or erecting the mast. Additional and/or alternative functions may be embodied or encompassed by the rotation mechanism through provision of the am.

The present disclosure is not limited in the disclosure extent to a mast being collapsible and encompasses many embodiments, to which the scope of protection of the disclosure is by no means limited, and which are set forth in the dependent claims and in the below embodiment description.

In an embodiment having at least the arm, the mast may exhibit the further feature that the arm is extendible from a shorter effective length in the upright extended state to a larger effective length in the collapsed state to keep the base and the top section apart in the collapsed state and have the base and top section abut in the upright extended state.

In such an embodiment, the mast may further exhibit the feature that the extendible arm is accommodated in a through hole in a mounting plate inside the top section, with a traction mechanism extending along the top section and back through an interior of the top section to the mounting plate. This provides a robust and secure manner of keeping the base and top section apart in the collapsed state of the mast.

Then the mast may further exhibit the feature that the traction mechanism is anchored on a boom, extending sideways from the base.

In an embodiment having the mounting plate and the boom, the mast may further exhibit the feature that the traction mechanism comprises a cable, wherein preferably the traction mechanism additionally comprises a pull, for example a spring.

Additionally or alternatively, the mast of the disclosure may exhibit the feature that the rotation mechanism comprises a track and cam mechanism configured to control respectively collapsing and erecting movement of the top section relative to the base. With a cam following a track, the movement path of the top section collapsing or being extended is more safely controlled to avoid unexpected movements, endangering personnel in the vicinity.

Additionally or alternatively, the mast of the disclosure may exhibit the feature that an interface between the base and the top section is oblique relative to the extent of the mast in the upright extended state. In such an embodiment, the interface may be at an angle of at least approximately 45 degrees.

Additionally or alternatively, the mast of the disclosure may exhibit the feature that the rotation mechanism comprises a drive motor arranged in either of the base and the top section, and a transmission connected with the drive motor and the rotation mechanism.

In such an embodiment with a drive motor and transmission, the drive motor may be at the output thereof connected with a flexidrive cable leading to the transmission.

In such an embodiment with a drive motor and transmission and potentially also a flexidrive cable, the transmission may comprise at an input side thereof a leadscrew.

In such an embodiment with a drive motor and transmission and potentially also a flexidrive cable and/or a leadscrew at the input of the transmission, the transmission may be a gearbox with spindle.

In such an embodiment with a drive motor and transmission and potentially also a flexidrive cable and/or a leadscrew at the input of the transmission and/or a gearbox with spindle, the transmission may comprise an input connected with an external connector, configured to be engaged by a manually applicable external drive, such as a drill. This allows manual override in case of drive motor failure and thereby enhanced safety.

In such an embodiment with a drive motor and transmission and potentially also a flexidrive cable and/or a leadscrew at the input of the transmission and/or a gearbox with spindle and/or external connector, the drive motor may be under control of a controller with a user input for commands to extend or collapse the top section. In such an embodiment, the user input may be arranged on or at the mast. In particular safety is enhanced when the user input is not remote, but at the mast, because—in view of progressive size increases in such yachts—remote control offers the risk of misjudging when the must should be collapsed, and when it can be allowed to be erected again.

After the above explanation of aspects of the present disclosure in terms of features defined in the appended claims, herein below an embodiment description will follow. Therein more technical detail is provided, where it is emphasised that the detail, features, aspects, components and functionalities to be described are in no way to be interpreted as limiting on the scope of protection, unless defined in the independent appended claim(s), and then still in particular in some jurisdictions equivalents are also included in the scope. Below, in the embodiment description, reference is made to the appended drawing, in which the same or similar aspects, components, elements and functionalities may be identified using the same or similar reference signs, even if described in relation to distinct embodiments. In the drawing:

Figure 1:
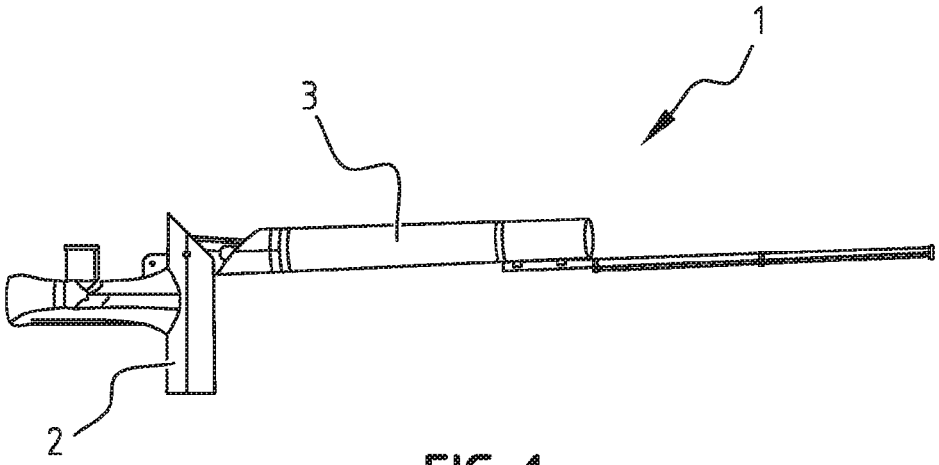
FIG. 1 shows a mast according to the disclosure in a collapsed state.
Figure 2:
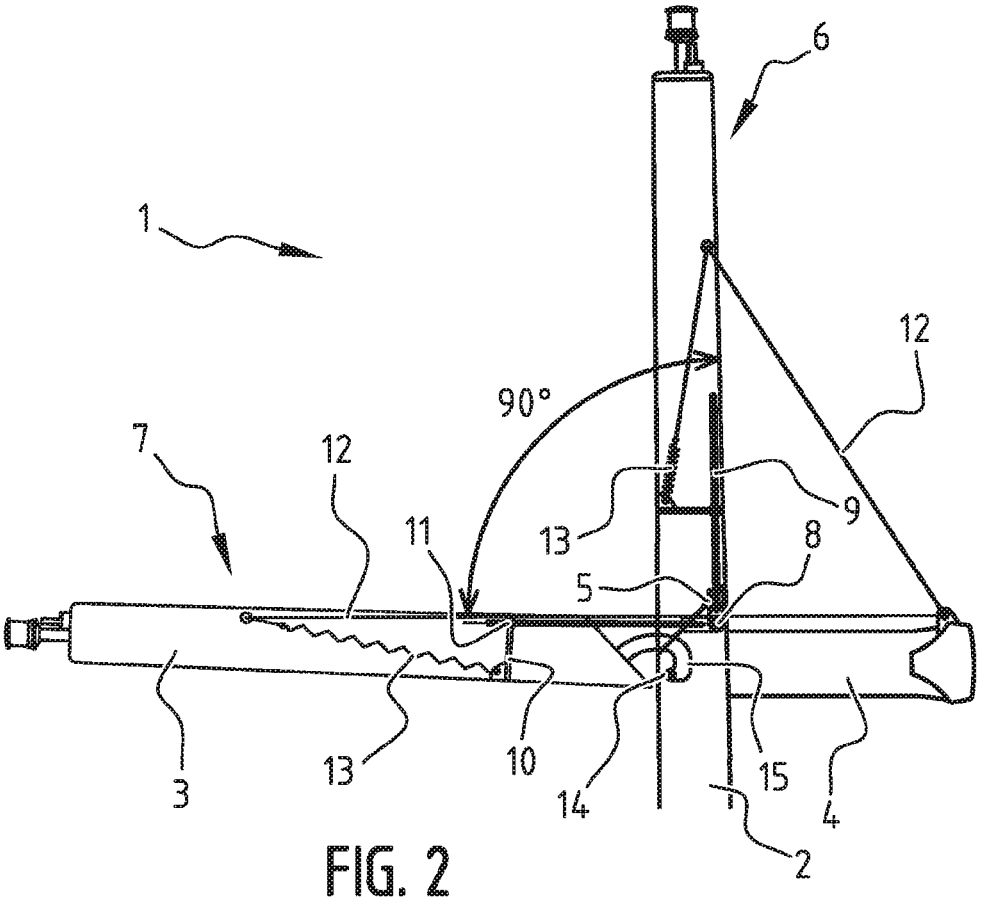
FIG. 2 shows schematically the technical working of a mast according to the present disclosure.

FIGS. 1 and 2 show a mast 1 according to the present disclosure, to have a base 2 and a collapsible top section 3. The base 2 is to be mounted on preferably a relatively large yacht. Extending sideways from the base 2 is a boom 4. The interface 5 between the base 2 and the top section 3 is oblique, allowing the top section 3 to be erected as indicated at 6 or collapsed as indicated at 7. As indicated in other figures also, a rotation mechanism is arranged between the base 2 and the top section 3. The rotation mechanism is configured to rotate the top section 3 relative to the base 2 between an upright extended state or position, indicated at 6, in which the top section 3 extends in line with the base 2, and a collapsed state or position, indicated at 7 in FIG. 2, in which the top section 3 is rotated downward to reduce a height of the mast on the yacht (not shown).

An arm 9 extends from a pivot 8 at base 2 into the top section 3 to carry, guide or support the top section 3. The pivot 8 is fact a transverse rotation axis 8, oriented transverse through the base 2 as is visible in FIGS. 3-5. The axis 8 may be rotatable in the base 2 with the arm 9, or the arm 9 may be rotatable around the axis 8. Either way, the arm 9 is rotatably connected to the base 2, and the arm is connected with the base 2 via the axis 8.

More in particular, the arm 9 extends through an over-dimensioned through hole 11 in a mounting plate 10 in the interior of the top section, such that the mounting plate 10 may travel over the arm 9, taking the entire top section 3 along, since the mounting plate is fixedly connected to the interior of the top section 3.

Thereby, the arm 9 is extendible from a shorter effective length in the upright extended state or position, into a larger effective length in the collapsed state. The effective length of arm 9 is between axis 8 and mounting plate 10, and varies with the state of the collapsible mast. This serves to keep the base 2 and the top section 3 apart in the collapsed state 7 and have the base 2 and top section 3 abut in the upright extended state 6. When the top section 3 is lowered or collapsed, the cable 12 and spring 13 assembly pulls the top section 3 away from the base 2. Clearly in FIG. 2, it is discernible that the effective length of the arm 9 between the pivot 8 and the mounting plate 10 is shorter in the upright erected position 6, than in the lowered collapsed position 7.

The extendible arm 9 is accommodated in the through hole 11 in the mounting plate 10 inside the top section 3, with a traction mechanism extending along the top section 3 and back through an interior of the top section 3 to the mounting plate 10. The traction mechanism is anchored on the boom 4, extending sideways from the base 2. The traction mechanism comprises cable 12, and a pull, here a spring 13. The spring 13 connects the mounting plate 10 to cable 12. Further, the rotation mechanism comprises a track 15 and cam 14 mechanism configured to control respectively collapsing and erecting movement of the top section 3 relative to the base 2. The track 15 and cam 14 mechanism defines the path travelled by the top section 3 when being collapsed or erected/extended.

It was noted already above that interface 5 between the base 2 and the top section 3 is oblique relative to the extent of the mast 1 in the upright extended state. Preferably, the interface 5 is at an angle of at least approximately 45 degrees. Other angles of the interface 5 are by no means excluded.

Figure 3:
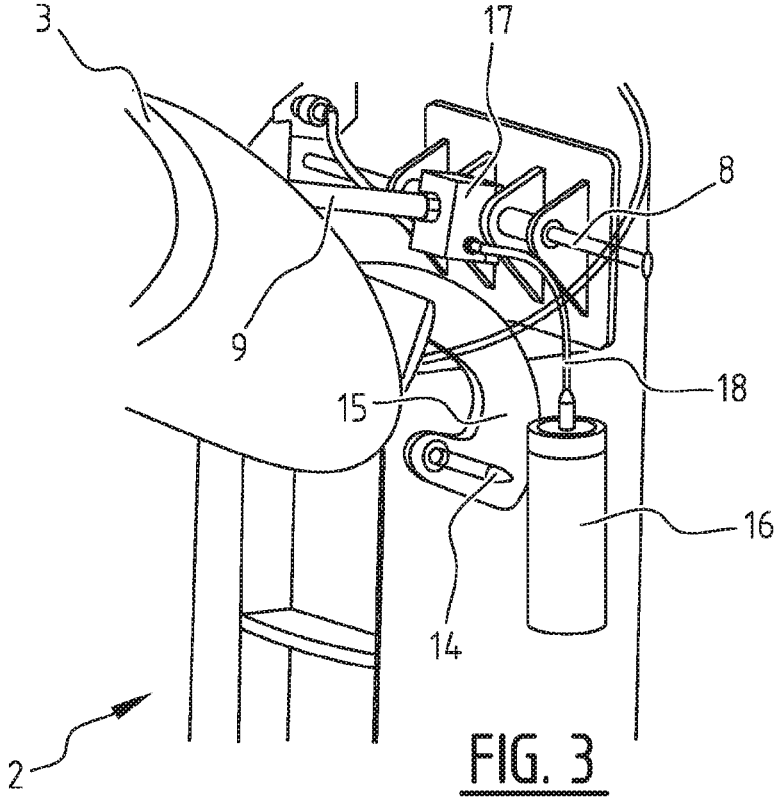
FIG. 3 shows more detail a side view of the interior configuration of a mast according to the present disclosure with a top section in a partially collapsed position.
Figure 4:
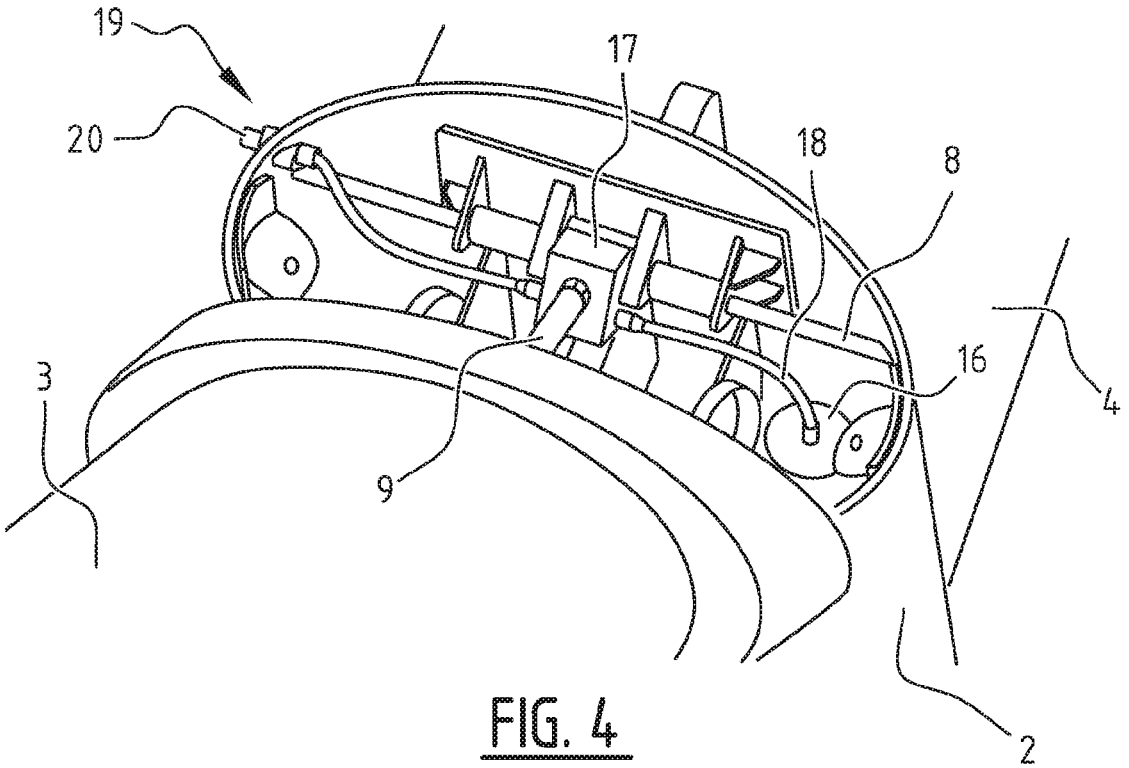
FIG. 4 shows a top view corresponding with the side view of FIG. 3.
Figure 5:
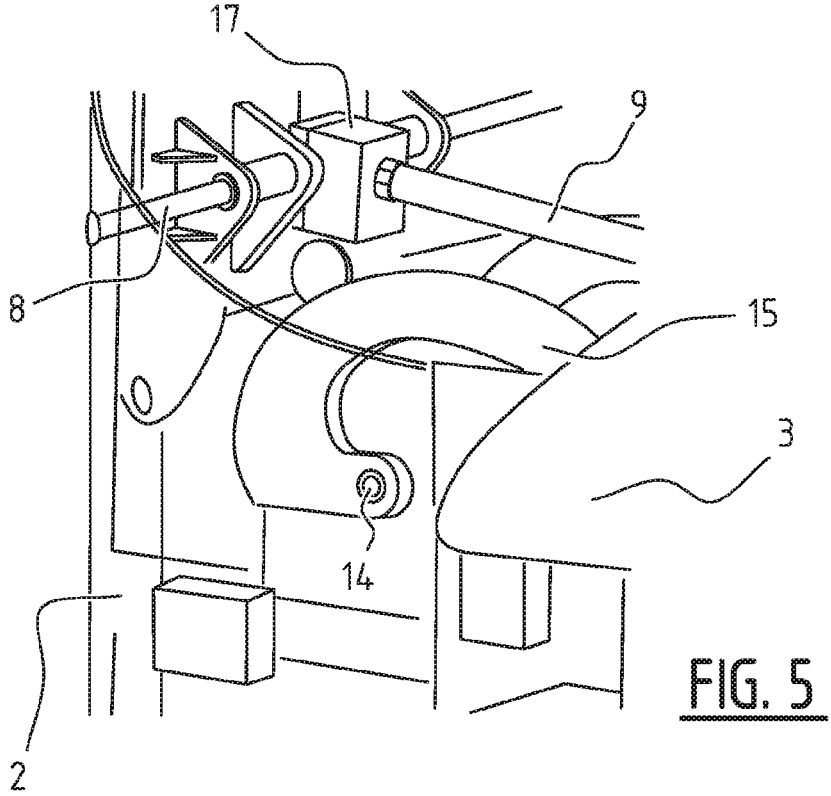
FIG. 5 shows a side view from an opposing perspective relative to FIG. 3.

As shown in FIGS. 3-5, the rotation mechanism further comprises a drive motor 16. Here the drive motor 16 is arranged in the base 2, but it can be arranged in either of the base 2 and the top section 3. The rotation mechanism further comprises a transmission 17 connected with the drive motor 16 and the axis 8 and arm 9 of the rotation mechanism.

Here, the drive motor 16 is at the output thereof connected with a flexidrive cable 18 leading to the transmission 17. The transmission 17 comprises at an input side thereof a lead-screw in a housing, so not visible, to transfer the rotating movement from the drive motor 16 to a gear assembly in the transmission 17, and further to the arm 9 for rotating the top section 3.

The drive may be embodied as a worm drive (not shown) as an alternative for the drive motor 16 and flexidrive cable 18. Additionally or alternatively, a drive may be embodied as a direct drive, a linear actuator or any other suitable drive form or embodiment.

Preferably, the transmission 17 is a gearbox with spindle. Alternatives are explicitly not excluded.

Further, the transmission 17 comprises an input 19 connected with an external connector 20, configured to be engaged by a manually applicable external drive, such as a drill. In this manner, the top section 3 can be made to erect or collapse, even in case of failure of the drive motor 16.

Figure 6:
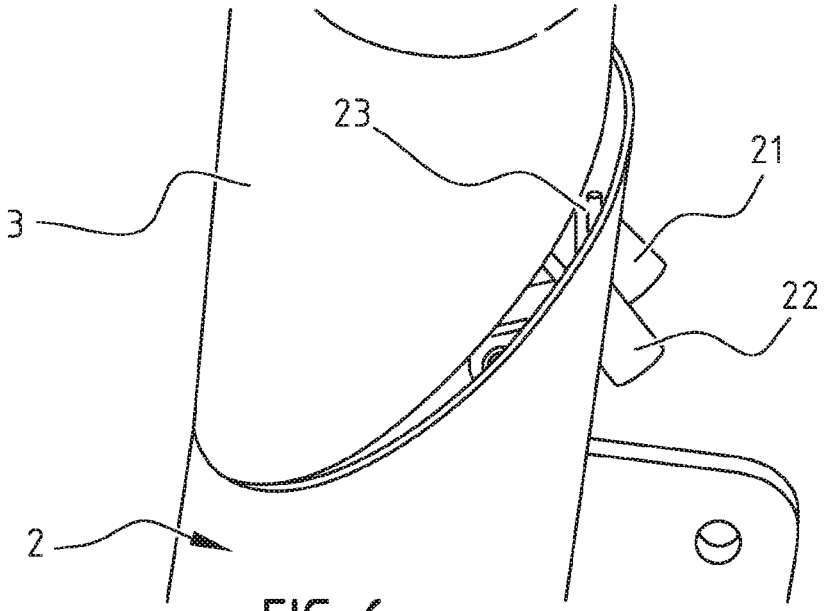
FIG. 6 shows a side view of the mast of the present disclosure in a near-erect position.

The drive motor 16 is preferably under control of a controller (not shown) with a user input 21, 22 for commands to extend or collapse the top section 3. The user inputs are locally situated, and in the embodiment of FIG. 6, two user inputs 21, 22 are arranged on or at the mast, more in particular on the base 2, one for erection of the top section 3 and one for collapsing the top section 3. As an alternative, a single button 21, 22 may embody the user input, to erect the top section when collapsed or collapse the top section, when erect.

The controller may monitor top section 3 movement, based on feedback from the drive motor 16 or from sensors. In the shown embodiment of FIG. 6, a proximity sensor 23 is provided to inform the control or directly slow down the motor 16, when the top section approximates the base 2 and an erect upright position 6 or state of the top section 3.

It is noted that the present disclosure encompasses many additional and/or alternative embodiments, even ones that have not been specifically shown in the appended drawing and/or described above. Such presently unforeseen embodiments are nonetheless encompassed within the scope of protection according to the appended claims.

The invention claimed is:

1. A collapsible mast for a yacht, comprising:

a base;

a top section; and a rotation mechanism arranged between the base and the top section configured to rotate the top section relative to the base between an upright extended state, in which the top section extends in line with the base, and a collapsed state, in which the top section is rotated downward to reduce a height of the mast, wherein the rotation mechanism comprises an axis oriented transverse through the base, wherein the rotation mechanism comprises a rotation arm, which is rotatably connected to the base via the axis;

wherein the arm is extendible from a shorter effective length in the upright extended state to a larger effective length in the collapsed state to keep the base and the top section apart in the collapsed state and have the base and top section abut in the upright extended state; and wherein the extendible arm is accommodated in a through hole in a mounting plate inside the top section, with a traction mechanism extending along the top section and back through an interior of the top section to the mounting plate.

2. The collapsible mast of claim 1, wherein the traction mechanism is anchored on a boom, extending sideways from the base.

3. The collapsible mast of claim 2, wherein the traction mechanism comprises a cable.

4. The collapsible mast of claim 3, wherein the traction mechanism additionally comprises a spring.

5. The collapsible mast of claim 1, wherein the rotation mechanism comprises a track and cam mechanism configured to control respectively collapsing and erecting movement of the top section relative to the base.

6. The collapsible mast of claim 1, wherein an interface between the base and the top section is oblique relative to the extent of the mast in the upright extended state.

7. The collapsible mast of claim 6, wherein the interface is at an angle of at least approximately 45 degrees.

8. The collapsible mast of claim 1, wherein the rotation mechanism comprises a drive motor arranged in either of the base and the top section, and a transmission connected with the drive motor and the rotation mechanism.

9. The collapsible mast of claim 8, wherein the drive motor is at the output thereof connected with a flexidrive cable leading to the transmission.

10. The collapsible mast of claim 8, wherein the transmission comprises at an input side thereof a leadscrew.

11. The collapsible mast of claim 8, wherein the transmission is a gearbox with spindle.

12. The collapsible mast of claim 8, wherein the transmission comprises an input connected with an external connector, configured to be engaged by a manually applicable external drive.

13. The collapsible mast of claim 8, wherein the drive motor is under control of a controller with a user input for commands to extend or collapse the top section.

14. The collapsible mast of claim 13, wherein the user input is arranged on or at the mast.

15. The collapsible mast of claim 8, wherein the drive motor is selected from a group consisting of an electric motor, a worm drive, a direct drive, and a linear actuator.

16. A collapsible mast for a yacht, comprising:

a base;

a top section; and a rotation mechanism arranged between the base and the top section configured to rotate the top section relative to the base between an upright extended state, in which the top section extends in line with the base, and a collapsed state, in which the top section is rotated downward to reduce a height of the mast, wherein the rotation mechanism comprises an axis oriented transverse through the base, wherein the rotation mechanism comprises a rotation arm, which is rotatably connected to the base via the axis;

wherein the rotation mechanism comprises a drive motor arranged in either of the base and the top section, and a transmission connected with the drive motor and the rotation mechanism; and wherein the drive motor is at the output thereof connected with a flexidrive cable leading to the transmission.

17. A collapsible mast for a yacht, comprising:

a base;

a top section; and a rotation mechanism arranged between the base and the top section configured to rotate the top section relative to the base between an upright extended state, in which the top section extends in line with the base, and a collapsed state, in which the top section is rotated downward to reduce a height of the mast, wherein the rotation mechanism comprises an axis oriented transverse through the base, wherein the rotation mechanism comprises a rotation arm, which is rotatably connected to the base via the axis;

wherein the rotation mechanism comprises a drive motor arranged in either of the base and the top section, and a transmission connected with the drive motor and the rotation mechanism; and wherein the transmission comprises an input connected with an external connector, configured to be engaged by a manually applicable external drive.

* * * * *